US008915719B2

(12) United States Patent
Street

(10) Patent No.: US 8,915,719 B2
(45) Date of Patent: Dec. 23, 2014

(54) CRYOGENIC RECIPROCATING PUMP INTERMEDIATE DISTANCE PIECE

(75) Inventor: John Charles Street, Spring, TX (US)

(73) Assignee: Air Products and Chemicals, Inc., Allentown, PA (US)

( * ) Notice: Subject to any disclaimer, the term of this patent is extended or adjusted under 35 U.S.C. 154(b) by 505 days.

(21) Appl. No.: 13/294,717

(22) Filed: Nov. 11, 2011

(65) Prior Publication Data

US 2013/0118424 A1 May 16, 2013

(51) Int. Cl.

| | |
|---|---|
| ***F04B 39/06*** | (2006.01) |
| ***F04B 1/04*** | (2006.01) |
| ***F25B 9/00*** | (2006.01) |
| ***F16J 15/18*** | (2006.01) |
| ***F01D 1/06*** | (2006.01) |
| ***F04B 53/02*** | (2006.01) |
| ***F04B 19/06*** | (2006.01) |
| ***F04B 53/08*** | (2006.01) |
| ***F04B 15/08*** | (2006.01) |

(52) U.S. Cl.

CPC ..... *F04B 15/08* (2013.01); *F04B 53/02* (2013.01); *F04B 19/06* (2013.01); *F04B 53/08* (2013.01)

USPC ..... 417/53; 417/273; 417/264; 417/373; 62/6; 92/168; 123/41.34

(58) Field of Classification Search

USPC ..... 417/53, 273, 364, 373; 62/6, 51.1, 474; 92/144, 168; 123/41.34

See application file for complete search history.

(56) References Cited

U.S. PATENT DOCUMENTS

| | | | | |
|---|---|---|---|---|
| 2,292,543 | A | 8/1942 | Patterson | |
| 2,730,957 | A | 1/1956 | Riede | |
| 3,109,293 | A | 11/1963 | Williams et al. | |
| 3,136,136 | A | 6/1964 | Gottzmann | |
| 3,145,629 | A | 8/1964 | Gottzmann | |
| 3,251,602 | A | 5/1966 | Williams et al. | |
| 3,263,622 | A | 8/1966 | Tyree, Jr. | |
| 4,396,354 | A | 8/1983 | Thompson et al. | |
| 4,396,362 | A | 8/1983 | Thompson et al. | |
| 4,576,557 | A | 3/1986 | Pevzner | |
| 4,639,197 | A | 1/1987 | Tornare et al. | |
| 4,968,219 | A | 11/1990 | Fisher-Votava | |
| 5,056,991 | A * | 10/1991 | Peschka et al. | 417/439 |
| 5,277,561 | A * | 1/1994 | Dresler et al. | 417/401 |
| 5,317,874 | A * | 6/1994 | Penswick et al. | 60/517 |
| 5,355,679 | A * | 10/1994 | Pierce | 62/6 |
| 5,511,557 | A | 4/1996 | Hazard et al. | |
| 5,765,378 | A * | 6/1998 | Stein et al. | 62/6 |
| 5,810,570 | A | 9/1998 | Nguyen | |
| 5,860,798 | A | 1/1999 | Tschopp | |
| 5,996,472 | A | 12/1999 | Nguyen et al. | |
| 6,305,265 | B1 * | 10/2001 | Bingham et al. | 92/168 |
| 6,547,250 | B1 | 4/2003 | Noble et al. | |
| 7,628,137 | B1 | 12/2009 | McAlister | |
| 2012/0234024 | A1 * | 9/2012 | Street et al. | 62/48.1 |

* cited by examiner

*Primary Examiner* — Charles Freay
(74) *Attorney, Agent, or Firm* — Eric J. Schaal

(57) ABSTRACT

The present invention teaches providing heating elements into the nose of an intermediate distance piece of a cryogenic reciprocating pump in order to warm the piston packing seals of the pump. The heating elements increase the temperature of the piston packing seals to limit deformation of the seals while the pump is in operation. In addition, a warm, dry vapor purge may be provided to the interior of the intermediate distance piece to reduce or eliminate rime from interfering with the piston packing seals.

18 Claims, 4 Drawing Sheets

CRYOGENIC RECIPROCATING PUMP INTERMEDIATE DISTANCE PIECE

BACKGROUND

Positive-displacement reciprocating pumps designed for cryogenic liquids, or cryogenic reciprocating pumps, are commonly used on portable equipment for oil field service and industrial applications where nitrogen is delivered as a cryogenic liquid, pumped to a higher pressure, vaporized, and then injected into a well, pipeline, vessel, or otherwise delivered for end use. Many of the commercially manufactured designs are comprised of a warm end, multiple cold ends in parallel, and intermediate distance pieces connecting each cold end to the warm end.

The warm end is further comprised of a housing, crankshaft, connecting rods, and crossheads that translate rotary motion to linear motion for the cold ends. The cold end is the pump body that comprises a plunger or piston, a cylinder, cylinder head, suction valve, and discharge valve. The intermediate distance pieces thermally isolate the warm end from the cold ends while aligning the cold end piston with the warm end crossheads.

The common commercial cold end designs have piston packing seals that are located just beyond the piston stroke length from the cold end cylinder. The piston packing seals prevent low pressure cryogenic nitrogen from leaking to the atmosphere and potentially spraying cryogenic nitrogen on the warm end crosshead oil seals that cannot tolerate cryogenic temperature.

The cold end piston operates below the freezing point of water, thus, ice can form on the portion of the cold end piston that is exposed to ambient air within the intermediate distance piece. A metallic scraper, also referred to as a wiper, may be positioned adjacent to the piston packing seals opposite from the cold end cylinder to clean contaminants, primarily ice, from the piston. The wiper is meant to protect the piston packing seals from physical damage from ice accumulation and other contaminants. The wiper has been proven to be effective when the cryogenic reciprocating pump is operated at a speed in the upper portion of its design envelope, but the wiper has proven to be ineffective when the cryogenic reciprocating pump is operated at lower speeds.

The piston packing seals are often plastic materials, commonly blends of Polytetrafluoroethylene (PTFE) and structural modifiers such as fiberglass or carbon. These materials are suitable for service at cryogenic temperatures, but have a thermal contraction rate much greater than the cold end piston that the piston packing seals surround. The difference in thermal contraction increases the stress in the piston packing seals at low temperatures resulting in increased cold flow deformation The design of many commercial cryogenic reciprocating pumps is a suitable compromise for many applications, particularly when the pump is operated for periods substantially less than ten hours before allowed to derime, or when the pump is rotated in the upper half of its design speed range. Their design, however, results in common issues when the pump is operated at lower speeds for an extended period of time. In continuous operation, ice formation on the cold ends and intermediate distance pieces continues to build up over a period of time. The ice buildup insulates the portions of the cold end and the intermediate distance piece surrounding the piston packing seals, and the temperature of the piston packing seals continues to decrease over hours after beginning continuous operation. An extended duration at cold temperatures contributes to deformation in the piston packing seals that prevents them from sealing when warmed up again. Furthermore, the common wipers have proven to be an effective measure to clean all condensation and frost resulting from exposure to ambient water vapor from the piston when operated at sufficient speed, but wipers, even in good condition, are often unable to remove hard rime that forms on the piston at low pump speed.

Previous cold end designs have included means for keeping the piston packing seals substantially warmer than the pumped fluid. Such features of various designs include elongated dimensions to reduce heat conducted from the piston packing, fins surrounding the piston packing to increase the transfer of heat from ambient air to the piston packing, insulating sections to thermally isolate the piston packing from the cold temperature within the pumping chamber, and a piston packing seal warming fluid jacket integral to the housing surrounding the piston packing seals. The drawback to these features is that they generally increase the dimensions of the cryogenic reciprocating pump, which is undesirable for mounting on a truck or trailer, and they make replacement of the cold ends more cumbersome.

Some features of the traditional cryogenic reciprocating pump designs emphasize reducing heat transferred into the cryogenic fluid as it is pumped in order to reduce vapor that must return to a cryogenic storage tank. Vapor returned to the tank increases the temperature of the stored cryogenic fluid, reducing the net positive suction head available to the cryogenic reciprocating pump. The returning vapor may also be vented directly to the atmosphere due to the operating pressure of the cryogenic storage tank. These features restrict heat transferred from the warm end into the cold end, and sometimes reduce heat transfer directly from ambient air through the cold end housing into the pumping chamber with a vacuum-insulated section.

Many of the commercial cryogenic reciprocating pumps designated by manufacturers for oil field service applications (e.g., ACD, NOV HydraRig, CS&P Technologies) do not use similar design features to limit heat transfer into the cold end because the equipment incorporating the cryogenic reciprocating pump typically also incorporates a cryogenic centrifugal pump to increase net positive suction head available to the cryogenic reciprocating pump. Furthermore, when vapor generated within the cryogenic reciprocating pump is vented to atmosphere, the amount is insignificant in comparison to the relatively high design rates of many cryogenic reciprocating pumps marketed for oil field applications.

The cold ends of cryogenic reciprocating pumps marketed for oil field service applications commonly allow liquid nitrogen within the cold end housing to be in direct contact with the piston packing seals. These pumps are designed to prevent excessive heat transfer from the warm end through the intermediate distance piece into the cold end to prevent freezing of lubricating oil within the warm end, but these designs do not incorporate any mechanism or feature to keep the piston packing seals well above the temperature of the cryogenic fluid. These designs of the cold ends marketed for oil field service also do not allow extended heat transfer surface area or a heating jacket on the cold end for the piston packing seals because the piston packing seals are installed in the section of the cold end housing that is immediately surrounded by the intermediate distance piece. Thus, the piston packing seals of cryogenic reciprocating pumps for oil field applications undergo repeated thermal expansion and contraction while restricted by adjacent parts within the cold ends, and the piston packing seals deform. Deformation in the piston packing seals compromises the ability to seal the fluid within the cold end housing.

Thus, there is a need in the art for a means to warm the piston packing seals in cryogenic reciprocating pump cold ends in which the piston packing seals are in close proximity with the cryogenic fluid, and in which there is no means to improve the cold end to warm the piston packing seals. The means to warm the piston packing seals is needed to increase the life of the piston packing seals when operated continuously and at low operating speeds.

SUMMARY

The disclosed embodiment satisfies the need in the art by providing an intermediate distance piece adapted to warm the piston packing seals, and means to prevent ice from accumulating on the cold end piston when a wiper is inadequate due to operation at low pump speed.

In one embodiment an intermediate distance piece is disclosed, comprising: heating elements to transfer heat through the cryogenic reciprocating pump cold end housing to warm the piston packing seals; sealing covers for the access windows of the intermediate distance piece that are otherwise necessary for mechanically coupling the warm end crosshead to the cold end piston; and a purge connection to eliminate ambient water vapor from within the intermediate distance piece by purging the intermediate with warm, dry vapor.

BRIEF DESCRIPTION OF SEVERAL VIEWS OF THE DRAWINGS

The foregoing summary, as well as the following detailed description of exemplary embodiments, is better understood when read in conjunction with the appended drawings. For the purpose of illustrating embodiments, there is shown in the drawings exemplary constructions; however, the invention is not limited to the specific methods and instrumentalities disclosed. In the drawings.

DETAILED DESCRIPTION

Figure 1:
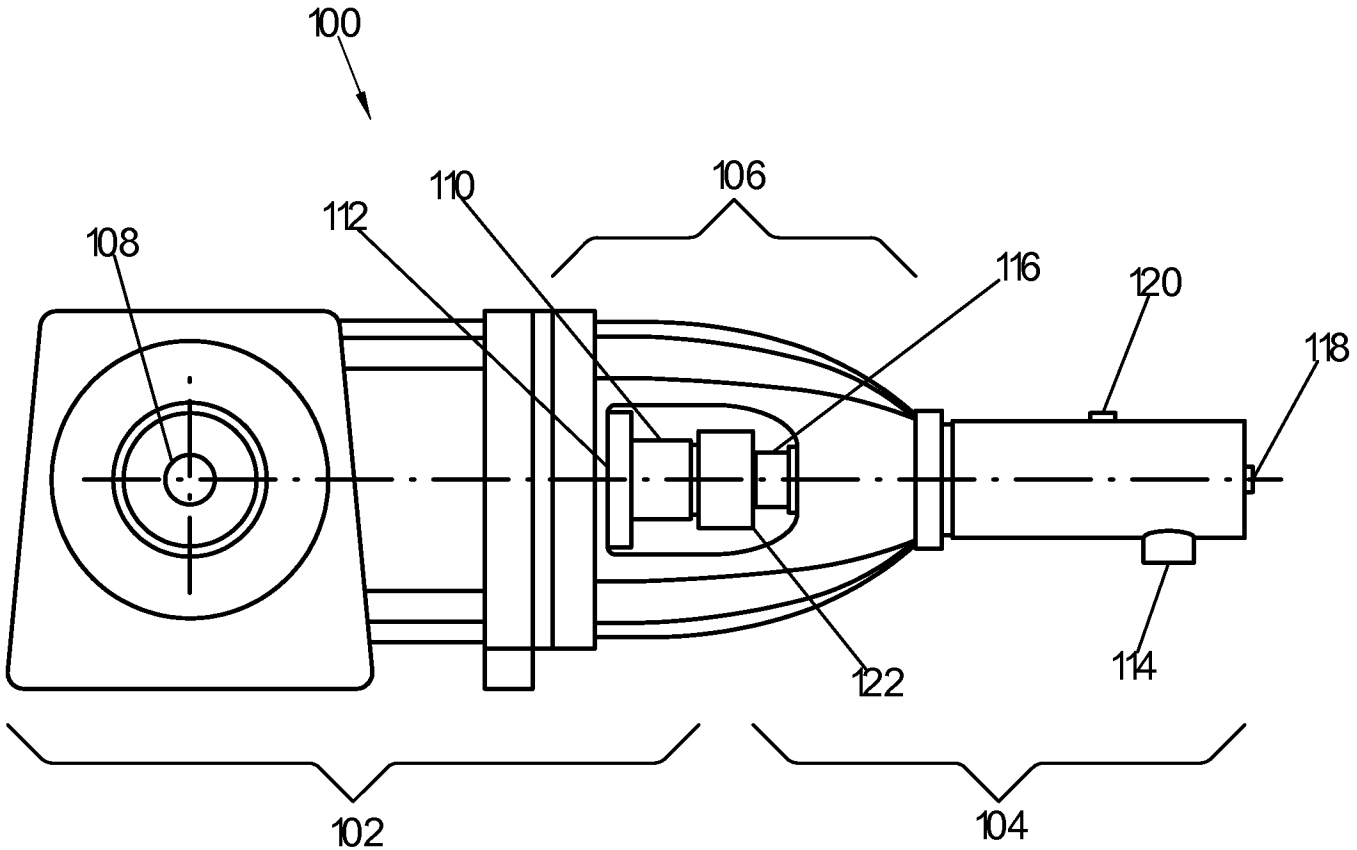
FIG. 1 is a drawing of an exemplary complete cryogenic reciprocating pump assembly comprising warm end, cold end, and intermediate distance piece.

The embodiment of the current invention concerns an intermediate distance piece for a cryogenic reciprocating pump comprising heating elements positioned to conduct heat through the housing of the cold end into the piston packing seals in conjunction with features of prior art including covers to seal air flow through the access windows of the intermediate distance piece and a port to introduce a supply of a dry gas to prevent intrusion of moisture in the internal volume of the intermediate distance piece.

The use of a seal purge is common on some cryogenic pumps, particularly for cryogenic centrifugal pumps for standby or continuous operation that must prevent ice formation at the pump face seal while the housing is cold. The seal purge improves seal life by preventing formation of ice, which becomes abrasive to seals. In contrast to centrifugal pumps, cryogenic reciprocating pumps commonly only use a plastic or metallic wiper positioned immediately on the atmospheric side of the packing seals with a sharp edge to eliminate contaminants such as dirt and ice to protect piston packing seals.

The wiper becomes less effective at removing hard rime at low pump speed for several reasons. The cold end piston is exposed to ambient air at the end of the suction stroke for longer periods of time at lower pump speeds. The longer duration exposed to atmospheric air increases the amount of moisture that condenses on the piston and provides a longer period of time to freeze before the exposed part of the piston travels through the wiper. The lower piston velocity generates less heat from friction than at higher speeds, so the cold end piston, cylinder, and piston packing seals all approach the temperature of the cryogenic fluid passing through the pump. Also, at low pump speed, the warm end of the pump is transmitting less power than at high speed at similar discharge pressure. At lower power throughput, the pump warm end will not operate much above ambient temperature and will conduct less heat through the intermediate distance piece to the piston packing seals.

Beyond operation at low pump speed, operation of a cryogenic reciprocating pump at low discharge pressure reduces the rate of cryogenic fluid that flashes to vapor while passing by the piston rings. This vapor is referred to as blowby vapor, and flows between the piston and the end of the pump cylinder opposite the head of the cold end. The blowby vapor must exit the area adjacent to the piston packing seals through porting at the back of the cold end cylinder, then travel through a longitudinal groove along the top of the cylinder sleeve to the vent port. Sufficient generation of blowby vapor insulates the piston packing seals to an extent from the denser cryogenic liquid by preventing the cryogenic liquid that passes through the grooves around the cold end cylinder sleeve from feeding through the ports at the back of the cylinder sleeve.

Cryogenic reciprocating pumps manufactured in triplex and quintuplex configurations for oil field service share a similar basis in the design of the intermediate distance piece with only few exceptions. The common design approach requires the cold end to be connected to the intermediate distance piece by mating threads on the outside diameter on the rear half of the cold end housing and on the bore at the nose of the intermediate distance piece. A threaded nut on the outside diameter of the cold end housing tightens against the nose of the intermediate distance piece when the cold end is set in the proper position based on cold end piston head clearance and direction of the cold end fluid ports.

Each intermediate distance piece has two windows positioned across the axis of the intermediate distance piece. The windows provide access for personnel to physically couple the cold end piston to the crosshead of the warm end. The majority of the pump designs do not offer a manufacturer-supplied cover for the windows of the intermediate distance piece; however, the windows can be sealed simply by taping heavy plastic sheet over the windows, or more permanently by fabricating window cover plates with closed-cell foam rubber seals.

The majority of intermediate distance piece designs for cryogenic reciprocating pumps for oil field service have one or more drain holes adjacent to the warm end crosshead oil seal. The drain holes are located at the bottom of the intermediate distance piece when installed on the warm end and serve to drain any residual oil and water. Alternately, intermediate distance pieces that are designed with the windows vertically across from the end of the crosshead may not have drain holes as the lower window will drain residual oil and water. When the windows of intermediate distance pieces with drain holes are sealed, no accommodations are necessary to vent purge gas or packing leaks. If the windows of intermediate distance pieces without drain holes are covered, the lower window cover must have ports to drain oil and water, to vent purge gas, and to prevent overpressurization if piston packing seal leaks occur.

The piston packing seals comprise multiple plastic seals that are meant to prevent pressure inside the cold end housing from escaping by the piston. The individual plastic seals are commonly separated from each other by metal spacers. One or more elastomeric o-rings around the metal spacers prevent pressure inside the cold end housing from escaping between the packing seals and the cold end housing. All of the components of the piston packing seals are loaded by a spring or springs to keep the components tight when the materials contract when cold.

It is not obvious to those skilled in the art that increasing the operating temperature of the piston packing seals will improve the longevity as the plastic seal materials commonly used are rated for cryogenic temperature. The plastic seals are commonly PTFE blended with structural modifiers such as fiberglass or carbon, but the PTFE-based seals are still susceptible to a phenomenon known as creep or cold flow, where deformation takes place slowly over a period of time due to continuous stress.

Furthermore, it is not obvious to those skilled in the art that application of heat to the intermediate distance piece would make a substantial increase in operating temperature of the piston packing seals as they are in close communication to circulating cryogenic fluid and the stainless housing of the cold end is not a good conductor of heat in comparison with aluminum or copper alloys or low alloy steel.

The plastic seal materials used in the piston packing seals have a coefficient of thermal expansion substantially higher than the stainless steel piston that they seal against. As the temperature of the piston and piston packing seals is lowered, the dimensions of free plastic seals shrink more than the piston. This increases the stress within the piston packing seals during operation. The increase in stress causes the rate of deformation of the piston packing seals to increase corresponding to decreasing temperature. After a set of piston packing seals exceeds 100 hours of cold operation, the piston packing seals remain in sealing contact with the piston while cold, but when the cold end is stopped and allowed to warm up, the inner diameter of the piston packing seals may not be in continuous circumferential contact with the piston, and would potentially leak until cooled again. It is optimal to increase the temperature of the packing during low temperature operation such that the piston packing seals remain tight on the piston when warm.

Applicants found with surprising result, however, that application of heat to the intermediate distance piece by circulating diesel engine coolant at 180 degrees into holes drilled into the nose of the intermediate distance piece warmed the piston packing area to the extent that the temperature of the packing gland was well above 32 F, apparent by a lack of frost and condensation, during continuous operation.

Applicants also found with surprising result that heating the intermediate distance piece caused an increase in the accumulation of ice on the cold end piston when operating the pump for periods greater than two hours at low speed. The increase of ice accumulation on the piston is believed to be the result of a localized environment within the intermediate distance piece with higher water vapor content in the air than when the intermediate is covered with ice, thus continually cooling the air in close proximity with the piston and condensing moisture into fog or frost on the surface of the intermediate distance piece.

None of the pump designs wherein the cold end housing screws into the intermediate distance piece offer any provision to apply heat to the cold end in a manner that would efficiently transfer heat to the piston packing seals. Addition of a heating jacket to the cold end housing in front of the cold end housing nut would likely result in substantially increased heat transferred to the cryogenic fluid at the head of the pump and within the pumping chamber increasing the likelihood of cavitation.

The intermediate distance pieces must accept cyclic tension loads ranging in force from approximately 15,000 pounds (66,723 N) to beyond 60,000 pounds (266,893 N). The intermediate distance pieces often have ribs to reinforce the sections of the components without the windows. The ribs are most commonly cast iron. The nose of the intermediate distance piece in front of the windows often has metal well beyond the minimum necessary to accept the cyclic load from operation, and some of this material can be removed without compromising the structural integrity of the component.

The embodiment of the disclosed invention concerns holes drilled into the nose of the intermediate distance piece for the purpose of inserting heating elements. Heat conducted through the nose of the intermediate distance piece is conducted through the mechanical thread connection to the cold end housing in a location that is nearly optimal to warm the piston packing seals.

Nitrogen pumpers that utilize cryogenic reciprocating pumps are powered by one or more diesel engines that must dissipate excess heat from the engine coolant to atmosphere through a radiator. The engine coolant is a suitable heating medium for the intermediate distance piece since the temperature is stable during normal operation, and the temperature will not exceed the temperature rating of the plastics and elastomers that comprise the piston packing seals. Preferably, a simple apparatus can be assembled to inject and circulate warm engine coolant into the drilled holes. Warm coolant from the discharge of the engine water pump can be divided with a minor fraction plumbed to a manifold to distribute the coolant to the holes in the intermediate distance pieces, while the major fraction circulates through the engine coolant galleries. The coolant circulated through the holes of the intermediate distance pieces can be returned to a section of the engine coolant circuit at lower pressure such as the engine coolant thermostat housing.

Alternatively, electrical resistance heating elements can be inserted into the drilled holes. The holes provide a substantial amount of heat transfer area in relation to the volume of metal within the nose of the intermediate distance piece. Furthermore, the mechanical threads connecting the cold end to the intermediate distance piece provide substantial surface area to transfer heat from the intermediate distance piece to the rear of the cold end housing. Heat at the rear of the cold end housing is transferred by conduction into the packing gland and by radiant heat transfer to the metal spacers that separate the piston packing seals.

Other alternate means of heating the intermediate distance piece without drilling heater element holes include, but are not limited to: fuel-fired radiant heaters; catalytic radiant heaters; electric radiant heaters including heat lamps; and electrical induction heating.

FIG. 1 illustrates a conventional triplex cryogenic reciprocating pump 100 designed for oil field service. The warm end 102 is connected to three cold ends 104 in parallel through three intermediate sections 106. For simplicity, only one cold end 104 and intermediate section 106 is shown in FIG. 1, the duplicate components assembled in line with the first. The warm end 102 transfers rotary power from the crankshaft 108 to reciprocating linear motion in crossheads 110. The warm end 102 is oil-lubricated, and oil seals 112 prevents lubricating oil from escaping by the reciprocating crossheads 110.

Cryogenic liquid enters the suction port 114 of cold end 104. A major fraction of the cryogenic liquid enters the pumping chamber (not shown) through a suction valve (not shown). Within the pumping chamber, the motion of piston 116 away from the warm end 102 increases the pressure of the cryogenic liquid within the pumping chamber, and the liquid flows through a discharge valve (not shown) and exits the cold end 104 through the discharge port 118. A minor fraction of the liquid entering the suction port 114 combines with blowby vapor that escapes past the piston rings (not shown) within the cold end 104 and exits through vent port 120 to return to the cryogenic liquid storage tank (not shown). The crosshead 110 transfers the reciprocating motion to the piston 116 through a mechanical coupling clamp 122.

Figure 2:
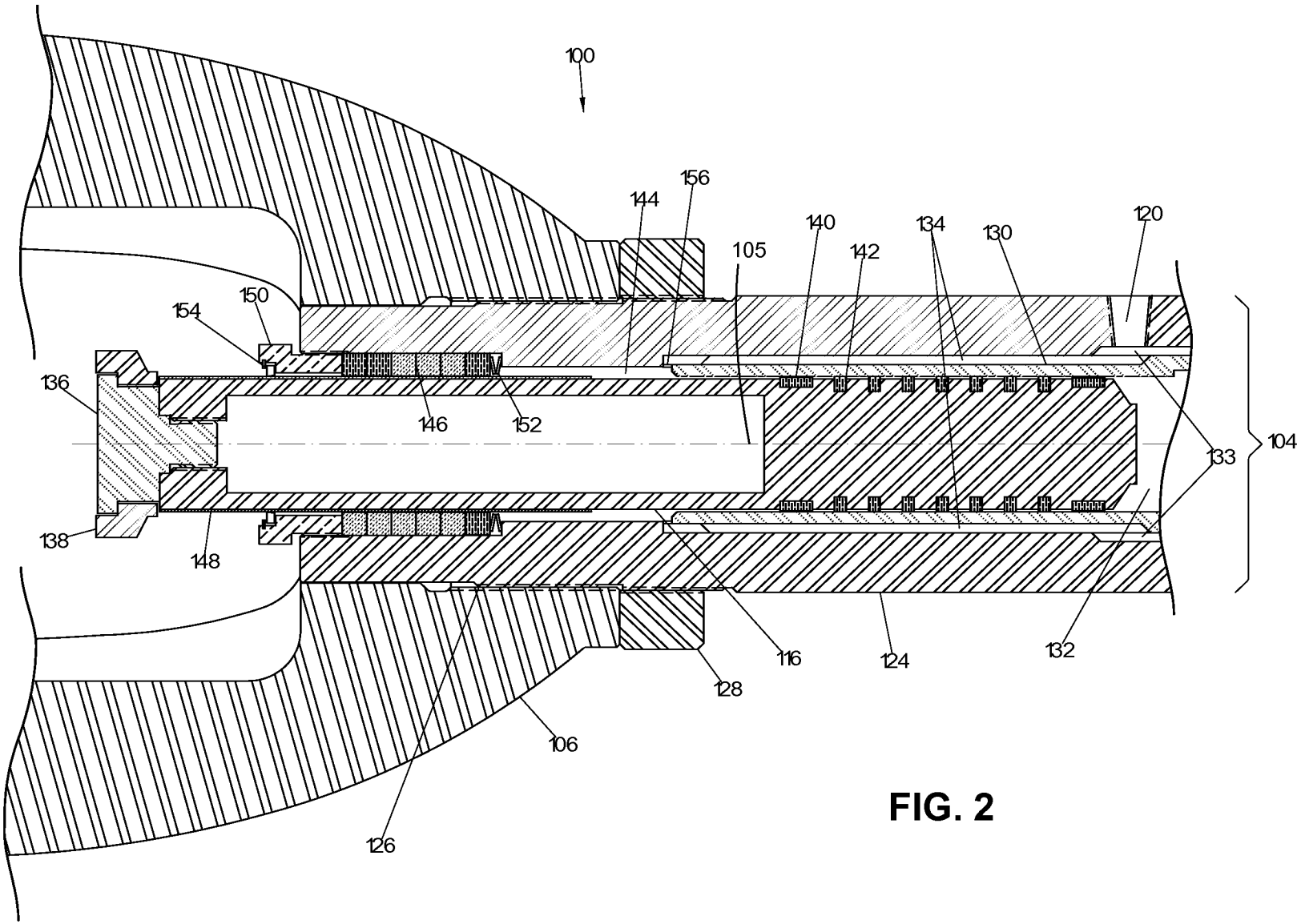
FIG. 2 is a cross-sectional partial view of an exemplary cold end of FIG. 1.

FIG. 2 illustrates a partial cutaway view of cryogenic reciprocating pump 100 including a cold end 104 and intermediate distance piece 106. The cold end 104 has a longitudinal axis 105. The housing 124 has male mechanical threads 126 that fixes the position of the cold end 104 in the intermediate distance piece 106. The housing nut 128 is screwed to tighten the engagement of the mechanical threads 126 against the intermediate distance piece 106.

The cylinder liner 130 contains the pumping chamber 132. Porting 133 within the interior of the housing 124 and longitudinal grooves 134 along the exterior of the cylinder liner 130 directs a minor fraction of the cryogenic fluid entering the suction port (not shown) of the cold end 104 around the cylinder liner 130 for cooling.

Piston 116 rides within the cylinder liner 130. The piston 116 is driven by the warm end crosshead (not shown). The crosshead (not shown) transfers motion to move the piston 116 to the head (not shown) directly into the knob 136. The crosshead (not shown) pulls the piston 116 away from the head (not shown) through a mechanical coupling clamp (not shown) that grips the beveled edge of the coupling adapter 138. Radial and axial tolerances between the knob 136 and coupling adapter 138 allows limited freedom of movement such that radial loads are not transmitted to the piston 116 from the crosshead (not shown).

Piston 116 is guided within the cylinder liner 130 by two rider bands 140. FIG. 2 illustrates that both rider bands 140 are located on opposite ends of piston rings 142; however, rider bands 140, in other embodiments, may also be positioned at other locations along the piston 116. The piston rings 142 seal the piston 116 against the cylinder liner 130 to prevent cryogenic liquid at higher pressure in the pumping chamber 132 from flowing past the piston 116.

Leakage past the piston rings 142 commonly forms a mixture of cryogenic liquid and vapor that flows into the annular space 144. Pressure within the annular space 144 is sealed from leaking to the atmosphere by the piston packing seals 146. The piston packing seals 146 seal against hard chrome plating 148 on the piston 116. The piston packing seals 146 are tightened by packing gland 150 against packing springs 152. The packing springs 152 keep the piston packing seals 146 tight as they contract more than the housing 124 when cooled from ambient temperature to cryogenic temperatures.

Moisture that collects on the hard chrome plating 148 due to condensation, freezing, and sublimation as well as other particulate contaminants from the air may be damaging to piston packing seals 146. Wiper 154, retained within packing gland 150, is meant to clean the moisture and contaminants off of the hard chrome plating 148 as the piston 116 is pushed by the crosshead (not shown).

The mixture of cryogenic liquid and vapor within annular space 144 must pass through restrictive openings 156 on the end of cylinder liner 130 to pass into the longitudinal grooves 134 around the cylinder liner 130. Within the longitudinal grooves 134, the cooling fluid from the porting 133 mixes with the fluid from the annular space 144, and exits the housing 124 through the vent port 120 and returns to the cryogenic liquid storage tank (not shown).

Figure 3B:
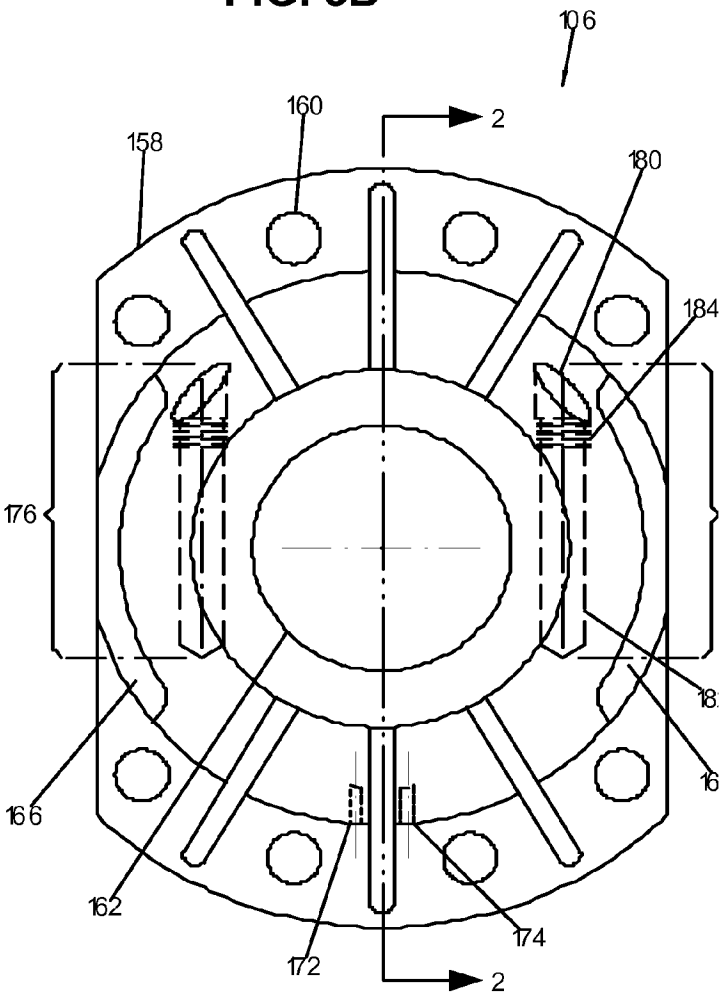
FIG. 3B is an end view of the same intermediate distance piece illustrated in FIG. 3A.
Figure 3A:
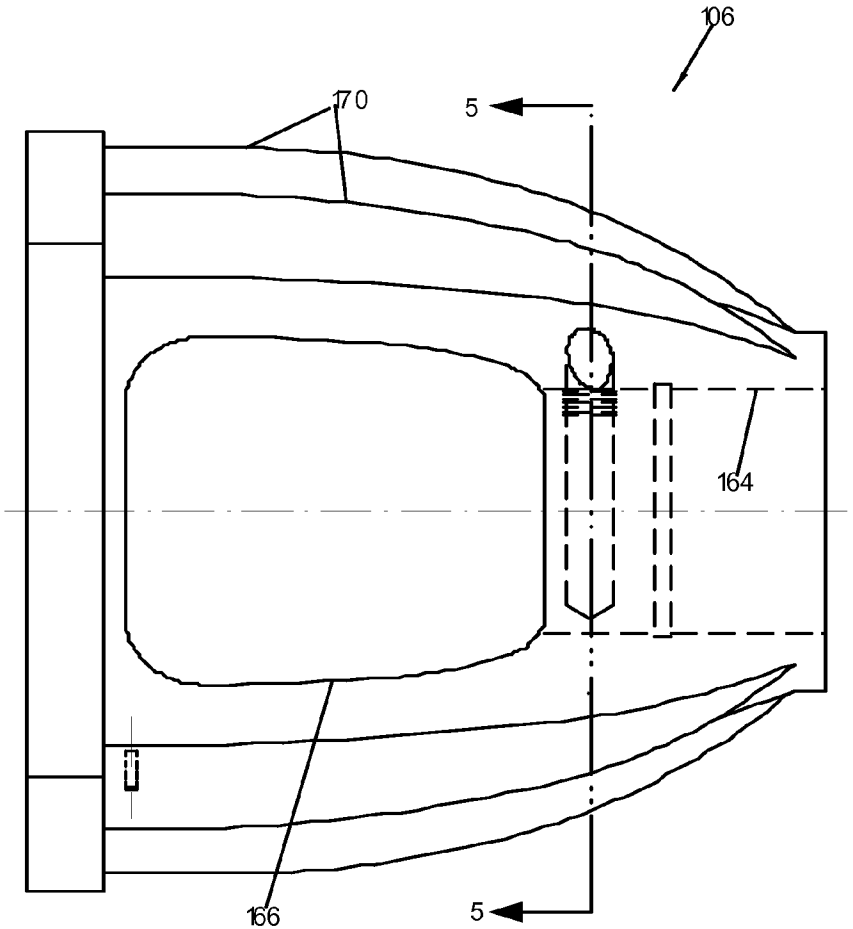
FIG. 3A is a profile view of an exemplary intermediate distance piece disclosed in accordance with the present invention.

FIGS. 3A and 3B illustrate an intermediate distance piece 106 in accordance with the present invention. FIG. 3A is a profile view of an exemplary intermediate distance piece disclosed in accordance with the present invention. FIG. 3B is an end view of an exemplary intermediate distance piece disclosed in accordance with the present invention. The intermediate distance piece 106 comprises a flange 158 with mounting holes 160 to mount the intermediate distance piece 106 to the warm end (not shown) via bolting (not shown). A cold end (not shown) is mounted within the intermediate distance piece 106 through hole 162 and secured with female mechanical threads 164. The intermediate distance piece 106 further comprises two windows 166 and 168 on opposite sides of the intermediate distance piece 106 that allow access to couple a cold end piston (not shown) to the warm end crosshead (not shown). Ribs 170 strengthen the intermediate distance piece 106 to operate under the cyclical load from the crosshead (not shown) to the cold end piston (not shown). The intermediate distance piece 106 illustrated has drain holes 172 and 174 below the crosshead oil seal (not shown). The drain holes 172 and 174 prevent oil seepage from the crosshead oil seal (not shown) and moisture condensed inside the intermediate distance piece 106 from pooling in the bottom of the intermediate distance piece 106.

Heating ports 176 and 178 are mirror image of each other, and are comprised of recess holes 180, bore holes 182, and tapered pipe threads 184. The recess holes 180 are milled to provide flat surfaces parallel to the plane bisecting the windows 166 and 168 for drilling the bore holes 182. The bore holes 182 are drilled near the widest part of the nose of intermediate distance piece 106, and normal to the plane bisecting the windows 166 and 168 of the intermediate distance piece 106. The bore holes 182 are positioned such that they extend well past the plane bisecting the windows 166 and 168 without drilling through the nose of the intermediate distance piece 106, and without intersecting hole 162 for installation of the cold end (not shown). After bore holes 182 are drilled, tapered pipe threads 184 are tapped at the top of bore holes 182 to allow installation of a fitting assembly (not shown) for coolant circulation within bore holes 182.

Figure 4:
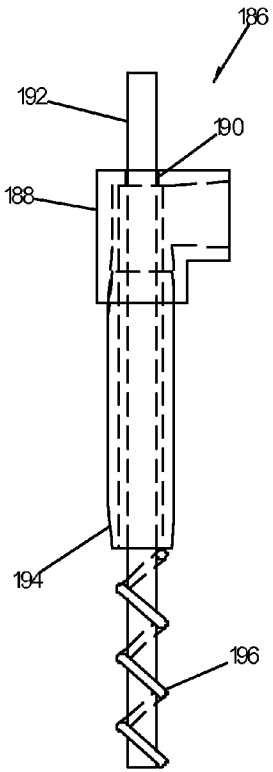
FIG. 4 is a drawing of an exemplary apparatus in accordance with the present invention.

FIG. 4 illustrates a fitting assembly 186 in accordance with the present invention. The fitting assembly 186 consists of a 90 degree metal threaded pipe elbow 188. The elbow 188 has a hole 190 drilled concentric to one axis that is slightly larger in diameter than metal tube 192. Metal tube 192 is inserted through the hole 190 drilled into the elbow 188, and the two components are joined by, for example, brazing or welding, depending on the alloys used. A threaded pipe nipple 194 is screwed into the port of elbow 188 through which tube 192 has been fixed, and the threaded connection is sealed by welding or brazing, for example. A thick wire 196 is wrapped in a helical pattern around the end of tube 192 protruding from the port of elbow 188, and both ends of the wire 196 are joined to the tube 192 by brazing or welding, for example. One fitting assembly 186 is connected to each heating port 176 of FIG. 3B of the intermediate distance pieces on a cryogenic reciprocating pump by, for example, applying threaded pipe sealant to the exposed threads of pipe nipple 194, and screwing the fitting assembly 186 into the heating port 176.

Figure 5:
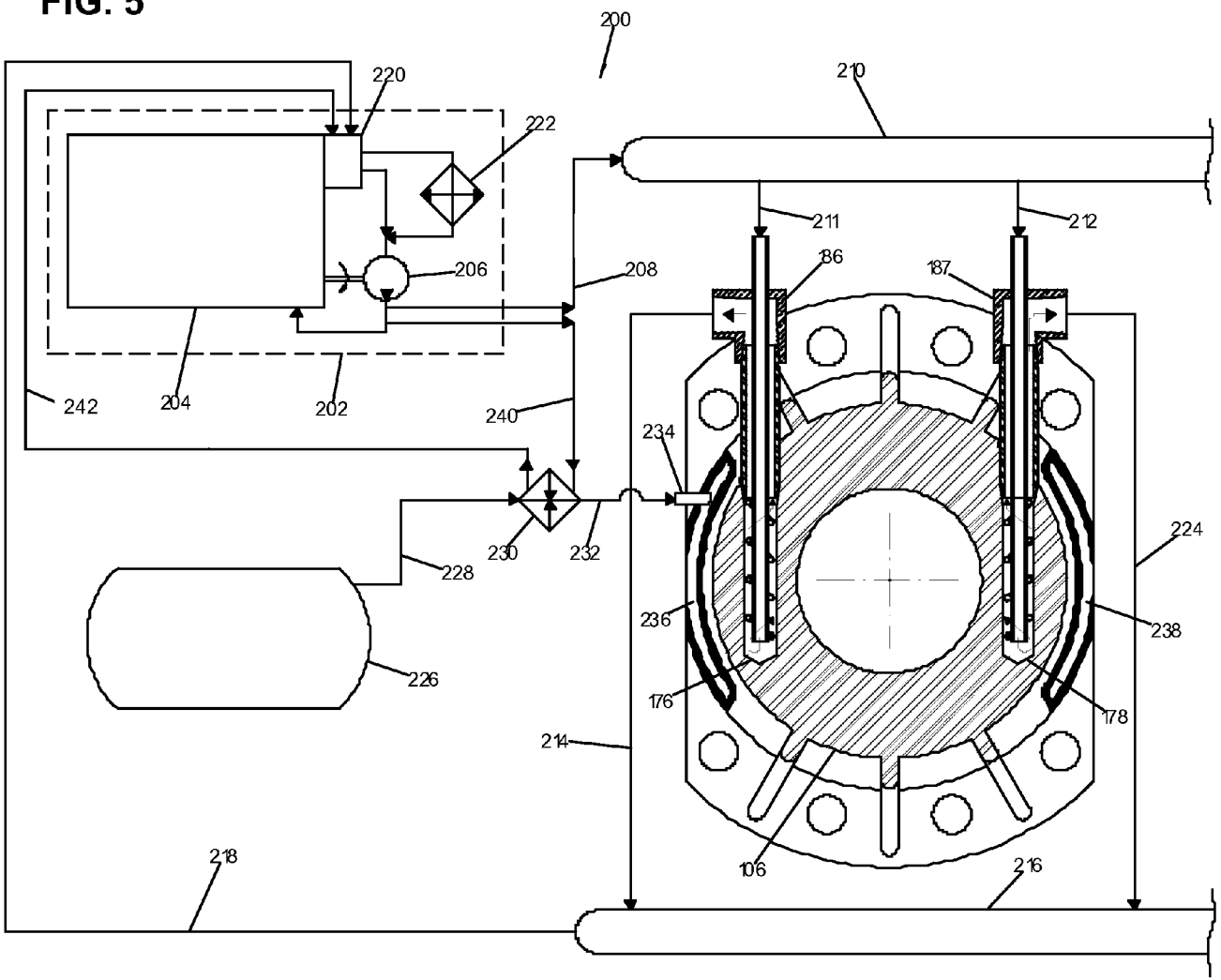
FIG. 5 is a schematic of a system comprising the intermediate distance piece disclosed in accordance with the present invention.

FIG. 5 illustrates a system 200 that uses engine coolant as a warming fluid in the intermediate distance piece heating ports in accordance with the present invention. Power unit 202 comprises diesel engine 204 with coolant pump 206, thermostat housing 220, and radiator 222. A cross-section view of intermediate distance piece 106 is shown through the axes of the heating ports 176 and 178. The flow of engine coolant from the coolant pump 206 is divided between a major fraction which flows through the engine coolant passages (not shown), a minor fraction which is plumbed through a coolant supply hose 208, and a minor fraction which is plumbed through flexible hose 240. The minor fraction of engine coolant from coolant supply hose 208 feeds a distribution manifold 210 to divide the flow of engine coolant among the two heating ports 176 and 178 of the intermediate distance piece 106 and all parallel duplicate intermediate distance pieces (not shown) of the cryogenic reciprocating pump. The distribution manifold 210 is connected to the fitting assembly 186 with a flexible hose 211 and to fitting assembly 187 with a flexible hose 212. The flow of engine coolant is discharged from fitting assembly 186 at the bottom of heating port 176, where the direction of coolant flow is reversed to flow along the wall of heating port 176. While in contact with the cooler walls of heating port 176, the coolant transfers heat into the nose of the intermediate distance piece 106. The coolant flows back through fitting assembly 186 into flexible hose 214. Coolant flows through fitting assembly 187 and heating port 178 in the same manner as heating port 176, and is discharged to flexible hose 224. Coolant from flexible hoses 214 and 224 flows into combining manifold 216. The combining manifold 216 returns all of the coolant through a coolant return hose 218 to return to the power unit 202 at the thermostat housing 220. Within the thermostat housing 220, the returning coolant mixes with the coolant stream circulating through the diesel engine 204, and is directed to the radiator 222 or directly to the coolant pump 206.

Cryogenic storage tank 226 contains cryogenic liquid nitrogen with a vapor space of cold gaseous nitrogen. In some embodiments, the cryogenic storage tank 226 may be the same source of cryogenic fluid that is used to introduce cryogenic fluid into the system 100, or separate cryogenic storage tanks may be used. In this embodiment, cold nitrogen vapor flows from the vapor space of cryogenic storage tank 226 through pipe 228 to heat exchanger 230. The minor fraction of engine coolant flowing through flexible hose 240 transfers heat into the cold nitrogen vapor in heat exchanger 230, where the cold nitrogen vapor is warmed above ambient temperature. The engine coolant returns from the heat exchanger 230 to the thermostat housing 220 through flexible hose 242. The warm nitrogen vapor exiting the heat exchanger 230 flows through flexible hose 232 into a purge port 234 of the window cover 236 into the open space within intermediate distance piece 106. The opposing window of intermediate distance piece 106 is sealed with window cover 238. Ambient water vapor within the open space of the intermediate distance piece 106 is flushed out to atmosphere with the warm nitrogen vapor through drain holes (not shown) and through the mechanical threads (not shown) of the intermediate distance piece 106. Ambient water vapor and warm nitrogen vapor may also escape through imperfections between the window covers 236 and 238 and the adjoining surfaces of the intermediate distance piece 106. The warm nitrogen vapor dilutes the concentration of water vapor within the open space in intermediate distance piece 106 to prevent water vapor from condensing, subliming, and freezing on the surface of the cold end piston (not shown) reciprocating within intermediate distance piece 106.

Additional Aspects of the Invention

Aspect 1. A reciprocating pump assembly for pumping a cryogenic fluid, the assembly comprising a warm end having a crankshaft and a crosshead; at least one cold end, each cold end having a piston, a pumping chamber, a suction port, a vent port and a discharge port; at least one coupling, each coupling connecting the warm end to one of the at least one cold end; and at least one intermediate distance piece, each of the at least one intermediate distance piece being connected to the warm end and to one of the at least one cold end, overlapping a portion of the one of the at least one cold end, and having at least one heating element at least partially contained therein, the at least one heating element being operatively disposed to allow for the circulation of a fluid through the at least one heating element.

Aspect 2. The reciprocating pump assembly according to Aspect 1, wherein each of the at least one cold end further comprises at least one piston packing seal, and wherein each of the at least one heating element is located at a first longitudinal position which at least partially overlaps with a second longitudinal position of the at least one piston packing seal, the first and second longitudinal positions being located along a longitudinal axis of the at least one cold end.

Aspect 3. The reciprocating pump according to Aspect 2, wherein the at least one heating element comprises a first heating element and a second heating element and wherein at least a portion of the at least one piston packing seal is located between the first heating element and the second heating element.

Aspect 4. The reciprocating pump assembly according to any one of Aspects 1-3, wherein each of the at least one intermediate distance piece further comprises at least one window formed therein to enable access to one of the at least one coupling from outside the at least one intermediate distance piece and a cover for each of the at least one window.

Aspect 5. The reciprocating pump assembly according to any one of Aspects 1-4, further comprising an internal combustion engine having a cooling system, wherein the fluid is a coolant that is circulated through the cooling system of the internal combustion engine.

Aspect 6. The reciprocating pump assembly according to Aspect 5, wherein the internal combustion engine is operatively disposed to drive the crankshaft.

Aspect 7. The reciprocating pump assembly according to any one of Aspects 1-6, further comprising a purge port located on each of the at least one intermediate distance piece, the purge port being connected to a supply of a cryogenic fluid, wherein each of the at least one intermediate distance piece defines an interior volume and the purge port is operatively disposed to inject the cryogenic fluid into the interior volume.

Aspect 8. The reciprocating pump assembly according to any one of Aspects 1-7, further comprising: a purge port located on each of the at least one intermediate distance piece, the purge port being in flow communication with a supply of a cryogenic fluid; and a heat exchanger operatively disposed to heat the cryogenic fluid against the coolant; wherein each of the at least one intermediate distance piece defines an interior volume and the purge port is operatively disposed to inject the cryogenic fluid into the interior volume.

Aspect 9. A method comprising: (a) pumping a first cryogenic fluid using a reciprocating pump assembly comprising a warm end having a crankshaft and a crosshead, at least one cold end, each cold end having a piston, a pumping chamber, a suction port, a vent port and a discharge port, at least one coupling that connects the warm end to one of the at least one cold end, at least one intermediate distance piece, each of the at least one intermediate distance piece being connected to the warm end, to one of the at least one cold end, and overlapping a portion of the warm end and a portion of the cold end; and (b) during at least a portion of the performance of step (a), circulating a fluid through at least one heating element located in each of the at least one intermediate distance piece.

Aspect 10. The method according to Aspect 9, wherein step (b) comprises circulating a fluid, having a temperature above ambient temperature, through at least one heating element located in each of the at least one intermediate distance piece.

Aspect 11. The method according to either of Aspects 9 or 10, further comprising: (c) covering any windows located on each of the at least one intermediate distance piece while step (a) is being performed.

Aspect 12. The method according to any of Aspects 9-11, further comprising: (d) circulating the fluid through a cooling system of an internal combustion engine.

Aspect 13. The method according to Aspect 12, further comprising: (e) driving the crankshaft with the internal combustion engine.

Aspect 14. The method according to any one of Aspects 9-13, further comprising: (f) purging an internal volume defined by each of the at least one intermediate distance piece using a second cryogenic fluid.

Aspect 15. The method according to Aspect 12, further comprising: (g) purging an internal volume defined by each of the at least one intermediate distance piece using a second cryogenic fluid; and (h) warming the second cryogenic fluid against the coolant prior to using the second cryogenic fluid in step (g).

Aspect 16. A system comprising a reciprocating pump assembly for pumping a cryogenic fluid, the assembly comprising: a warm end having a crankshaft and a crosshead; at least one cold end, each cold end having a piston, at least one piston packing seal, a pumping chamber, a suction port, a vent port, a discharge port and a longitudinal axis; at least one coupling, each coupling connecting the warm end to one of the at least one cold end; and at least one intermediate distance piece having at least one window formed therein to enable access to one of the at least one coupling from outside the at least one intermediate distance piece and a cover for each of the at least one window, each of the at least one intermediate distance piece being connected to the warm end and to one of the at least one cold end, overlapping a portion of the one of the at least one cold end, and having first and second heating elements at least partially contained therein at a longitudinal position which at least partially overlaps with a longitudinal position of the at least one piston packing seal; and an internal combustion engine having a cooling system in flow communication with each of the at least one heating element to enable circulation of a coolant fluid through the cooling system of the internal combustion engine and each of the at least one heating element, the internal combustion engine being operatively disposed to drive the crankshaft.

Aspect 17. The system according to Aspect 16, further comprising a purge port located on each of the at least one intermediate distance piece, the purge port being connected to a supply of a cryogenic fluid, wherein each of the at least one intermediate distance piece defines an interior volume and the purge port is operatively disposed to inject the cryogenic fluid into the interior volume.

Aspect 18. The system according to either of Aspects 16 or 17, further comprising a heat exchanger operatively disposed to heat the cryogenic fluid against the coolant fluid.

EXAMPLES

One of the three intermediate distance pieces of an ACD 3-LMPD triplex cryogenic reciprocating pump was modified by milling two ⅞" (22.2 mm) diameter recess holes into the nose of the intermediate distance piece. Two holes with 23/32" (18.3 mm) diameter were drilled from each of the recess holes to a depth of 2-½" (63.5 mm) from the base of the recess hole. The top of each hole was tapped with ½" NPS (15 DN) NPT threads.

Two fitting assemblies were built with ⅜" (9.5 mm) diameter 304 stainless steel seamless tubing, ½" NPS (15 DN) NPTF female 90 degree brass elbows, and ½" NPS (15 DN) Schedule 80 red brass thread-both-end pipe nipples. The fittings were joined by silver brazing. The ⅜" (9.5 mm) tubing extended approximately 3" (76.2 mm) beyond the close nipple. The fittings were assembled into the intermediate distance piece heater ports and sealed with PTFE thread sealant. The intermediate distance piece was installed on a 3-LMPD warm end on a nitrogen pumper unit. A cold end was installed in the intermediate distance piece with the heating ports and fitting assemblies.

During prior testing, the cold end was determined to have begun cyclically leaking cold nitrogen vapor from the piston packing seals within two hours of operation at low speed and low discharge pressure. Now, the engine coolant was circulated through the heating ports and fitting assemblies of the intermediate distance piece when the diesel engine of the nitrogen pumper was started. The cold end was cooled down and began pumping at a low rate of 50 rpm and low discharge pressure less than 100 psig (689 kPa). Within one hour, cold nitrogen vapor was observed to be leaking cyclically from the piston packing seals. The rime visible on the hard chrome plating of the piston formed quicker than during prior operation without heating the intermediate distance piece; however, neither frost nor condensation was observed on the internal surface of the intermediate distance piece. Without heating the intermediate distance piece, it was common for frost to cover the entire internal surface of the intermediate distance piece adjacent to the cold end packing gland.

After shutting down the pump and allowing it to warm to ambient temperature, the trial was further adapted by applying vinyl-coated polyester fabric covers to the windows of the intermediate distance piece with heating ports and fitting assemblies. The covers were sealed around the edges of the windows with adhesive tape. Nitrogen vapor from the cryogenic storage tank on the nitrogen pumper unit was warmed above ambient temperature by warm engine coolant through a brazed-plate heat exchanger. The warmed nitrogen vapor was run through tubing into one of the window covers to purge the interior of the intermediate distance piece. The flow rate of the nitrogen purge was controlled between 1 to 5 SCFM (28.4 to 142.1 SLPM).

The cold end was then cooled down and operated again at the same rate and pressure for four hours. During this period, the window cover was peeled back periodically for inspection of the back of the cold end. No rime formed on the hard chrome plating of the piston and there was no visible nitrogen leaked through the piston packing seals.

The following Table 1 presents the results from the trials:

TABLE 1

| | Trial #1 | Trial #2 | Trial #3 |
|---|---|---|---|
| Summary | No coolant in heating ports, no window covers, and no purge | Coolant flowing through heating ports, no window covers, and no purge | Coolant flowing through heating ports, windows covered, and nitrogen purge in intermediate distance piece |
| Duration | 2 hours | 1 hour | 4 hours |
| Frost on intermediate distance piece | Frost approximately 6 inches (15.2 cm) from nose | Frost no further than 1.5 inches (3.8 cm) from nose | Frost no further than 1.5 inches (3.8 cm) from nose |
| Rime on piston chrome plating | Rime evident | Rime formed quicker than in Trial #1 | No rime visible when window covers pulled back for inspection |
| Packing seal leakage | Cold vapor leakage visible between piston and piston packing seals | Cold vapor leakage visible between piston and piston packing seals | No apparent leakage evident at intermediate distance piece drain holes, nor visible when window covers pulled back for inspection |

Examination after disassembly of cold ends also indicated a reduction in the deformation of the piston packing seals. After operating for 200 hours, piston packing seals for cold ends with 2.00 inch (50.8 mm) bore are commonly expanded larger than the outside diameter of the hard chrome plating on the piston at room temperature when the intermediate distance piece has no means for warming the piston packing seals. When the cold end from the trial was disassembled after 250 hours of operation, the piston packing seals were still tight with no gap between the piston packing seals and the hard chrome plating of the piston.

The trials indicate that the intermediate distance piece with heating elements, alone, did reduce deformation in the piston packing seals, but did not improve the performance due to the increase in the formation of hard rime on the hard chrome plating of the piston. When used in conjunction with sealing covers and a warm, dry vapor purge on the interior of the intermediate distance piece, hard rime is eliminated from interfering with the piston packing seals. Furthermore, airborne particulates are also eliminated from the interior of the intermediate distance piece, which may also benefit the longevity of the piston packing seals and the warm end crosshead oil seals.

Thus, as described in the examples, the intermediate distance piece with heating elements, sealing covers, and a warm, dry vapor purge on the interior satisfies the need in the art for means to warm the piston packing seals in cryogenic reciprocating pump cold ends in which the piston packing seals are in close proximity with the cryogenic fluid, and in which there is no means to improve the cold end to warm the piston packing seals. The heating elements increase the temperature of the piston packing seals to limit deformation while in operation. The sealing covers and warm, dry vapor purge on the interior of the intermediate distance piece eliminate moisture that would otherwise freeze on the hard chrome plating of the piston and damage the piston packing seals.

The invention claimed is:

1. A reciprocating pump assembly for pumping a cryogenic fluid, the assembly comprising:

a warm end having a crankshaft and a crosshead;

at least one cold end, each cold end having a piston, a pumping chamber, a suction port, a vent port and a discharge port;

at least one coupling, each coupling connecting the warm end to one of the at least one cold end; and at least one intermediate distance piece, each of the at least one intermediate distance piece being connected to the warm end and to one of the at least one cold end, overlapping a portion of the one of the at least one cold end, and having at least one heating element at least partially contained therein, the at least one heating element being operatively disposed to allow for the circulation of a fluid through the at least one heating element.

2. The reciprocating pump assembly of claim 1, wherein each of the at least one cold end further comprises at least one piston packing seal, and wherein each of the at least one heating element is located at a first longitudinal position which at least partially overlaps with a second longitudinal position of the at least one piston packing seal, the first and second longitudinal positions being located along a longitudinal axis of the at least one cold end.

3. The reciprocating pump assembly of claim 2, wherein the at least one heating element comprises a first heating element and a second heating element and wherein at least a portion of the at least one piston packing seal is located between the first heating element and the second heating element.

4. The reciprocating pump assembly of claim 1, wherein each of the at least one intermediate distance piece further comprises at least one window formed therein to enable access to one of the at least one coupling from outside the at least one intermediate distance piece and a cover for each of the at least one window.

5. The reciprocating pump assembly of claim 1, further comprising an internal combustion engine having a cooling system, wherein the fluid is a coolant that is circulated through the cooling system of the internal combustion engine.

6. The reciprocating pump assembly of claim 5, wherein the internal combustion engine is operatively disposed to drive the crankshaft.

7. The reciprocating pump assembly of claim 1, further comprising a purge port located on each of the at least one intermediate distance piece, the purge port being connected to a supply of a cryogenic fluid, wherein each of the at least one intermediate distance piece defines an interior volume and the purge port is operatively disposed to inject the cryogenic fluid into the interior volume.

8. The reciprocating pump assembly of claim 5, further comprising:

a purge port located on each of the at least one intermediate distance piece, the purge port being in flow communication with a supply of a cryogenic fluid; and a heat exchanger operatively disposed to heat the cryogenic fluid against the coolant;

wherein each of the at least one intermediate distance piece defines an interior volume and the purge port is operatively disposed to inject the cryogenic fluid into the interior volume.

9. A method comprising:

(a) pumping a first cryogenic fluid using a reciprocating pump assembly comprising a warm end having a crankshaft and a crosshead, at least one cold end, each cold end having a piston, a pumping chamber, a suction port, a vent port and a discharge port, at least one coupling that connects the warm end to one of the at least one cold end, at least one intermediate distance piece, each of the at least one intermediate distance piece being connected to the warm end, to one of the at least one cold end, and overlapping a portion of the warm end and a portion of the cold end; and (b) during at least a portion of the performance of step (a), circulating a fluid through at least one heating element located in each of the at least one intermediate distance piece.

10. The method of claim 9, wherein step (b) comprises circulating a fluid, having a temperature above ambient temperature, through at least one heating element located in each of the at least one intermediate distance piece.

11. The method of claim 9, further comprising:

(c) covering any windows located on each of the at least one intermediate distance piece while step (a) is being performed.

12. The method of claim 9, further comprising:

(d) circulating the fluid through a cooling system of an internal combustion engine.

13. The method of claim 12, further comprising:

(e) driving the crankshaft with the internal combustion engine.

14. The method of claim 9, further comprising:

(f) purging an internal volume defined by each of the at least one intermediate distance piece using a second cryogenic fluid.

15. The method of claim 12, further comprising:

(f) purging an internal volume defined by each of the at least one intermediate distance piece using a second cryogenic fluid; and (g) warming the second cryogenic fluid against the coolant prior to using the second cryogenic fluid in step (f).

16. A system comprising:

a reciprocating pump assembly for pumping a cryogenic fluid, the assembly comprising:

a warm end having a crankshaft and a crosshead;

at least one cold end, each cold end having a piston, at least one piston packing seal, a pumping chamber, a suction port, a vent port, a discharge port and a longitudinal axis;

at least one coupling, each coupling connecting the warm end to one of the at least one cold end; and at least one intermediate distance piece having at least one window formed therein to enable access to one of the at least one coupling from outside the at least one intermediate distance piece and a cover for each of the at least one window, each of the at least one intermediate distance piece being connected to the warm end and to one of the at least one cold end, overlapping a portion of the one of the at least one cold end, and having first and second heating elements at least partially contained therein at a longitudinal position which at least partially overlaps with a longitudinal position of the at least one piston packing seal; and an internal combustion engine having a cooling system in flow communication with each of the at least one heating element to enable circulation of a coolant fluid through the cooling system of the internal combustion engine and each of the at least one heating element, the internal combustion engine being operatively disposed to drive the crankshaft.

17. The system of claim 16, further comprising a purge port located on each of the at least one intermediate distance piece, the purge port being connected to a supply of a cryogenic fluid, wherein each of the at least one intermediate distance piece defines an interior volume and the purge port is operatively disposed to inject the cryogenic fluid into the interior volume.

18. The system of claim 17, further comprising a heat exchanger operatively disposed to heat the cryogenic fluid against the coolant fluid.

* * * * *